US012704132B2

(12) United States Patent
Perevozchikov et al.

(10) Patent No.: US 12,704,132 B2
(45) Date of Patent: Aug. 11, 2026

(54) COOLING CIRCUITS FOR COMPRESSORS AND COMPRESSORS INCLUDING SAME

(71) Applicant: Copeland LP, Sidney, OH (US)

(72) Inventors: Michael M. Perevozchikov, Tipp City, OH (US); Patrick Shawn O'Meara, Tipp City, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 19/010,796

(22) Filed: Jan. 6, 2025

(65) Prior Publication Data

US 2026/0194069 A1 Jul. 9, 2026

(51) Int. Cl.

| | |
|---|---|
| ***F04D 29/58*** | (2006.01) |
| ***F04D 17/12*** | (2006.01) |
| ***F04D 29/056*** | (2006.01) |
| ***F04D 29/42*** | (2006.01) |

(52) U.S. Cl.

CPC ..... *F04D 29/5806* (2013.01); *F04D 17/122* (2013.01); *F04D 29/056* (2013.01); *F04D 29/4206* (2013.01)

(58) Field of Classification Search

CPC ..... F04D 29/5806; F04D 29/2266; F04D 29/056; F04D 17/12; F04D 17/122; F04D 25/06

See application file for complete search history.

(56) References Cited

U.S. PATENT DOCUMENTS

| | | | | |
|---|---|---|---|---|
| 6,102,672 | A | 8/2000 | Woollenweber et al. | |
| 6,196,809 | B1 | 3/2001 | Takahashi et al. | |
| 6,909,210 | B1 * | 6/2005 | Bostwick | H02K 5/203 310/58 |
| 7,240,515 | B2 * | 7/2007 | Conry | F04D 25/06 62/510 |
| 8,931,304 | B2 | 1/2015 | Beers et al. | |
| 9,206,819 | B2 | 12/2015 | Maier | |
| 9,644,633 | B2 | 5/2017 | Laboube et al. | |

(Continued)

FOREIGN PATENT DOCUMENTS

WO 2017015729 A1 2/2017

OTHER PUBLICATIONS

Bennett, Edward; Low-GWP HVAC System With Ultra-small Centrifugal Compression; Technical Report; May 28, 2018; pp. 1-3.

*Primary Examiner* — Nathaniel E Wiehe
*Assistant Examiner* — Jackson N Gillenwaters
(74) *Attorney, Agent, or Firm* — Armstrong Teasdale LLP

(57) ABSTRACT

A compressor system includes a compressor housing, a shaft rotationally supported within the compressor housing, a first impeller operably connected to the shaft at a first end, a second impeller operably connected to the shaft at a second end, a motor operably connected to the shaft, and a cooling circuit. The cooling circuit includes a coolant inlet passage for introducing an inlet coolant flow into the cooling circuit, and a cooling channel connected in fluid communication with the coolant inlet passage. The cooling channel extends helically around the motor and includes a first portion and a second portion. Each of the first portion and the second portion extends from the coolant inlet passage to respective first and second outlets such that the inlet coolant flow is split into a first coolant flow along the first portion and a second coolant flow along the second portion.

19 Claims, 9 Drawing Sheets

(56) References Cited

U.S. PATENT DOCUMENTS

| | | | | |
|---|---|---|---|---|
| 9,777,746 | B2 | 10/2017 | Maier | |
| 10,072,468 | B2 | 9/2018 | Heiden et al. | |
| 10,941,788 | B2 | 3/2021 | Iizuka et al. | |
| 11,177,489 | B2 | 11/2021 | Sakota et al. | |
| 11,248,612 | B2 | 2/2022 | Sakota et al. | |
| 11,306,726 | B2 | 4/2022 | Perevozchikov et al. | |
| 11,609,030 | B2 * | 3/2023 | Heisey | F25B 31/026 |
| 12,152,603 | B2 * | 11/2024 | Henke | F04D 25/06 |
| 12,320,361 | B2 * | 6/2025 | Hirano | F04D 25/06 |
| 2009/0044548 | A1 * | 2/2009 | Masoudipour | F25B 1/04 62/505 |
| 2015/0308456 | A1 * | 10/2015 | Thompson | F04D 17/12 417/244 |
| 2017/0335756 | A1 * | 11/2017 | Donkin | F04D 25/045 |
| 2022/0178593 | A1 * | 6/2022 | Thornton | F25B 31/026 |
| 2022/0220976 | A1 | 7/2022 | Perevozchikov et al. | |
| 2024/0018966 | A1 | 1/2024 | Hirano | |

* cited by examiner

COOLING CIRCUITS FOR COMPRESSORS AND COMPRESSORS INCLUDING SAME

FIELD

The field of the disclosure relates generally to cooling systems for compressors and, more particularly, to cooling systems for use with centrifugal compressors and refrigeration systems including the same.

BACKGROUND

Centrifugal compressors have certain advantages over positive displacement compressor designs, such as reciprocating, rotary, and screw compressors. The incorporation of centrifugal compressors in lower-capacity cooling systems may be limited due to the high rotational speed of the impeller of a centrifugal compressor and the associated challenges of providing a suitable operating environment for the impeller and associated motor. One particular challenge is providing sufficient cooling to the motor and bearings associated with the compressor shaft to maintain the motor and bearings within a suitable range of operating temperatures.

Conventionally, two-stage compressors have a plurality of inlets for introducing coolant to separate cooling paths. For example, some two-stage compressors may include a first coolant inlet and a first coolant path for supplying coolant to one or more bearings of the first compression stage, a second coolant inlet and second coolant path for supplying coolant to one or more bearings of the second compression stage, as well as a third coolant inlet and third coolant flow path for supplying coolant to the motor. Multiple coolant paths, positioned at various locations or different sides of the compressor, and and/or inlets can increase cost and complexity.

This background section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a compressor system includes a compressor housing, a shaft rotationally supported by a first bearing and a second bearing within the compressor housing, a first impeller operably connected to the shaft at a first end of the shaft, and a second impeller operably connected to the shaft at a second end of the shaft. The compressor system also includes a motor operably connected to the shaft between the first bearing and the second bearing and a cooling circuit. The cooling circuit includes a coolant inlet passage defined by the compressor housing for introducing an inlet coolant flow into the cooling circuit and a cooling channel defined by the compressor housing and connected in fluid communication with the coolant inlet passage. The cooling channel extends helically around the motor and includes a first portion and a second portion. Each of the first portion and the second portion extends from the coolant inlet passage to respective first and second outlets such that the inlet coolant flow is split into a first coolant flow along the first portion and a second coolant flow along the second portion.

In another aspect, a compressor system includes a compressor housing, a shaft rotationally supported by a first bearing and a second bearing within the compressor housing, a first impeller operably connected to the shaft at a first end of the shaft, and a second impeller operably connected to the shaft at a second end of the shaft. The compressor system also includes a motor operably connected to the shaft between the first bearing and the second bearing and a cooling circuit. The cooling circuit includes a coolant inlet passage defined by the compressor housing for introducing an inlet coolant flow into the cooling circuit and a cooling channel defined by the compressor housing and connected in fluid communication with the coolant inlet passage. The cooling channel extends helically around the motor. The cooling channel includes a first portion and a second portion. Each of the first portion and the second portion extends from the coolant inlet passage to respective first and second outlets such that the inlet coolant flow is split into a first coolant flow along the first portion and a second coolant flow along the second portion. Each of the first portion and the second portion includes a respective flow resistance coefficient, and the flow resistance coefficient of the first portion is greater than the flow resistance coefficient of the second portion.

In yet another aspect, a compressor system includes a compressor housing, a shaft rotationally supported by a first bearing and a second bearing within the compressor housing, a first impeller operably connected to the shaft at a first end of the shaft, and a second impeller operably connected to the shaft at a second end of the shaft. The compressor system includes a motor operably connected to the shaft between the first bearing and the second bearing and a cooling circuit. The cooling circuit includes a coolant inlet passage defined by the compressor housing for introducing an inlet coolant flow into the cooling circuit and a channel connected in fluid communication with the coolant inlet passage. The channel wraps at least partially around the motor. The channel includes a first portion and a second portion and each of the first portion and the second portion extends from the coolant inlet passage to respective first and second outlets such that the inlet coolant flow is split into a first coolant flow along the first portion and a second coolant flow along the second portion. A cross-sectional area of the first portion is substantially the same as a cross-sectional area of the second portion, and wherein the first portion has a first length longer than a second length of the second portion.

In one aspect, a compressor system includes a compressor housing, a shaft rotationally supported by a first bearing and a second bearing within the compressor housing, a first impeller operably connected to the shaft at a first end of the shaft, a second impeller operably connected to the shaft at a second end of the shaft, and a motor operably connected to the shaft between the first bearing and the second bearing. The compressor system includes a cooling circuit including a first coolant inlet passage defined by the compressor housing for introducing a first coolant flow into the cooling circuit and a second coolant inlet passage defined by the compressor housing for introducing a second coolant flow into the cooling circuit. The cooling circuit includes a cooling channel defined by the compressor housing and connected in fluid communication with the first and second coolant inlet passages. The cooling channel extends helically around the motor and includes a first portion and a second portion. The first portion extends from the first coolant inlet passage to a first outlet and the second portion extends from the second coolant inlet passage to a second outlet such that the first coolant flow travels along the first portion and the second coolant flow travels along the second portion.

In another aspect, a compressor system includes a compressor housing, a shaft rotationally supported by a first bearing and a second bearing within the compressor housing, a first impeller operably connected to the shaft at a first end of the shaft and a second impeller operably connected to the shaft at a second end of the shaft. The compressor system includes a motor operably connected to the shaft between the first bearing and the second bearing, and a cooling circuit. The cooling circuit includes a first coolant inlet passage defined by the compressor housing for introducing a first coolant flow into the cooling circuit, a second coolant inlet passage defined by the compressor housing for introducing a second coolant flow into the cooling circuit, and a cooling channel defined by the compressor housing and connected in fluid communication with the first and second coolant inlet passages. The cooling channel extends helically around the motor and includes a first portion and a second portion. The first portion extends from the first coolant inlet passage to a first outlet and the second portion extends from the second coolant inlet passage to a second outlet such that the first coolant flow travels along the first portion and the second coolant flow travels along the second portion. Each of the first portion and the second portion includes a respective flow resistance coefficient. A flow resistance coefficient of the first portion is different than a flow resistance coefficient of the second portion.

In yet another aspect, a compressor system includes a compressor housing, a shaft rotationally supported by a first bearing and a second bearing within the compressor housing, a first impeller operably connected to the shaft at a first end of the shaft and a second impeller operably connected to the shaft at a second end of the shaft. The compressor system includes a motor operably connected to the shaft between the first bearing and the second bearing and a cooling circuit. The cooling circuit includes a first coolant inlet passage defined by the compressor housing for introducing a first coolant flow into the cooling circuit, a second coolant inlet passage defined by the compressor housing for introducing a second coolant flow into the cooling circuit, and a cooling channel defined by the compressor housing and connected in fluid communication with the first and second coolant inlet passages, wherein the cooling channel extends helically around the motor and includes a first portion and a second portion. The first portion extends from the first coolant inlet passage to a first outlet and the second portion extends from the second coolant inlet passage to a second outlet such that the first coolant flow travels along the first portion and the second coolant flow travels along the second portion. A cross-sectional area of the first portion is substantially the same as a cross-sectional area of the second portion. A second outlet area of the second outlet is greater than a first outlet area of the first outlet.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
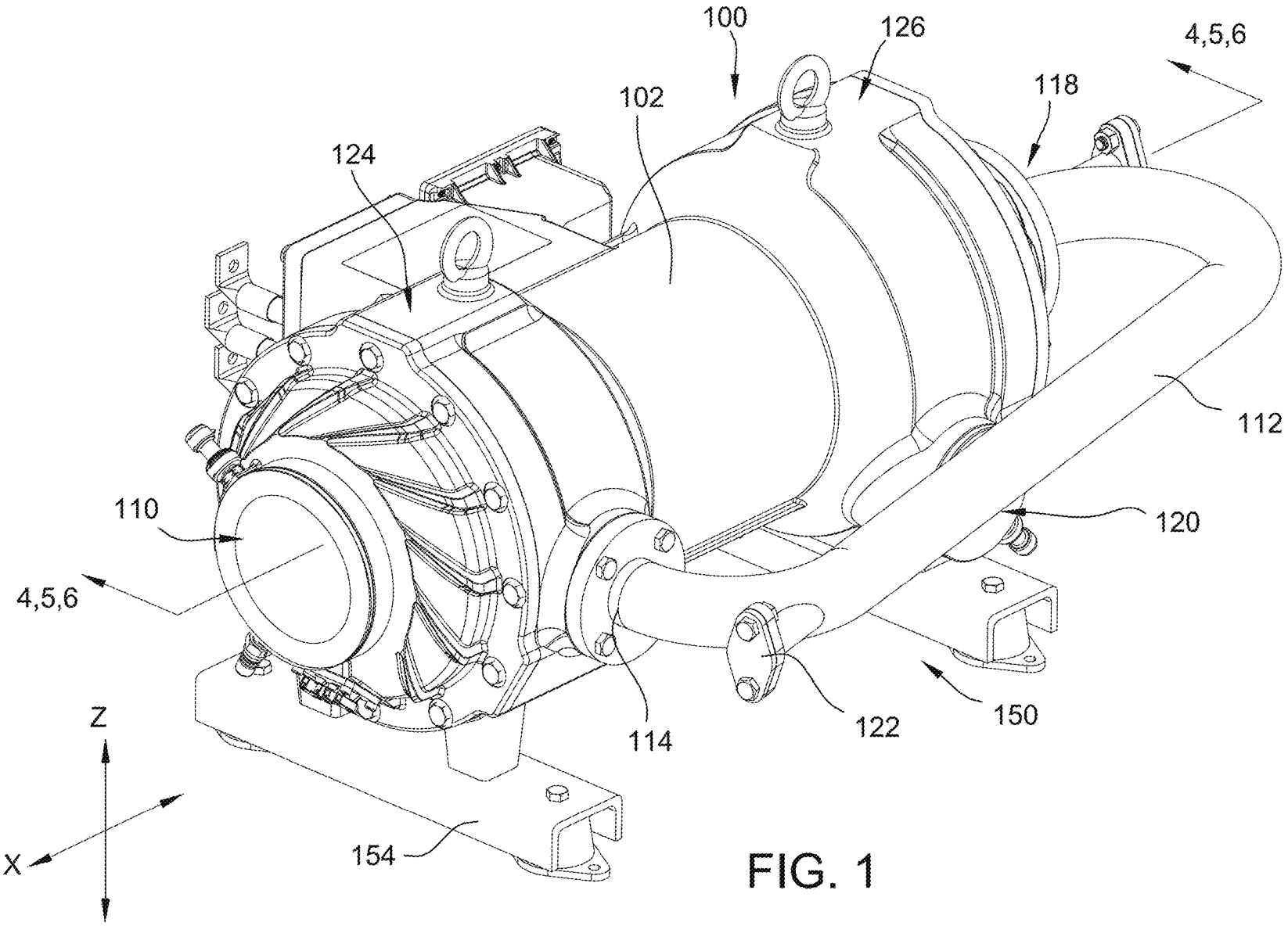
FIG. 1 is a perspective view of an example compressor.
Figure 2:
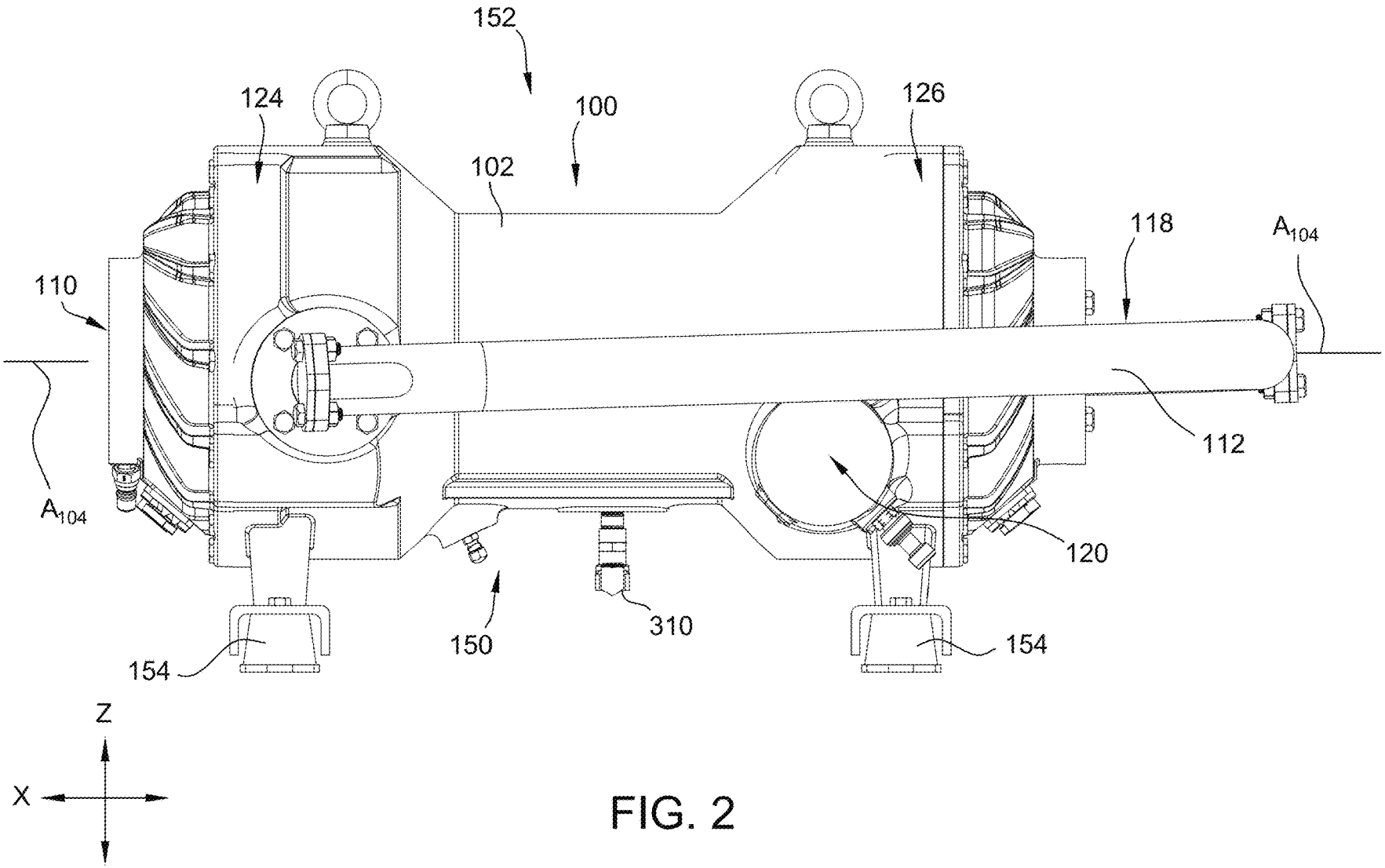
FIG. 2 is a side view of the compressor shown in FIG. 1.

In some embodiments of the compressor housings and coolant flow paths described herein enable delivery of coolant fluid to a plurality of components of a compressor by supplying coolant flow through a single inlet line to a single inlet port, thereby reducing or eliminating the need for multiple individual coolant delivery lines and inlet ports and improving ease of use and/or decreasing installation times and associated costs. For example, a technician will only need to install a single coolant line and/or connect a single flow control device, e.g., a solenoid valve, to the single inlet.

Embodiments of the coolant flow paths described herein enable selective distribution of the inlet coolant flow to components of a compressor. For example, the coolant flow path includes one or more features which diverts a majority of the inlet coolant flow to one compression stage (e.g., a first or second compression stage), as compared to an amount of inlet coolant flow that is delivered to another compression stage. In some embodiments, for example, one of the compression stages (e.g., the second compression stage) has a higher operating temperature as compared to the other compression stage (e.g., the first compression stage). A higher operating temperature of one of the compression stages may be at least partially caused by the compression stage having a greater load as compared to the other compression stage. An increase in the pressure of a working fluid, received by a compression stage, increases the load on the compression stage and likewise, increases the operating temperature of the compression stage. For example, the first compression stage compresses a working fluid from a first pressure to a second pressure, greater than the first pressure. The second compression stage, downstream from the first compression stage, receives compressed working fluid at the second pressure and as such, the second compression stage has a greater load, compared to the first compression stage, and likewise a higher operating temperature. Accordingly, a greater amount of coolant flow can be delivered to the compression stage having the higher operating temperature to facilitate uniform cooling of the compressor.

Embodiments of the coolant flow path include a cooling channel including a first portion for delivering coolant flow to the first compression stage and a second portion for delivering coolant flow to the second compression stage. Each of the first and second portions may be characterized by a flow resistance parameter which is influenced by one or more features of the channels. The one or more features of the coolant flow path which diverts the inlet coolant flow to different components of the compressor may be a passive feature eliminating the need for additional flow control devices and/or complicated control systems. For example, the coolant flow path may include a first flow path, leading toward the first bearing and a second flow path leading towards the second bearing, where the first flow path is longer than the second flow path. Additionally, or alternatively, the first flow path may include an outlet that has a cross-sectional area that is greater than a cross-sectional area of an outlet of the second flow path.

In another embodiment described herein, coolant flow is supplied to two inlet ports, arranged in proximity to each other, such that the cooling channel includes a first portion for delivering coolant flow to the first compression stage, a second portion for delivering coolant flow to the second compression stage, and a third portion disposed therebetween for delivering coolant flow to a motor. The first and second portions have a shortened distance to outlets in proximity to the first and second compression stages, thereby enabling coolant flow to be supplied to the first and second compression stages without delay. In addition, a majority of the total supplied inlet coolant flow is delivered to the first and second compression stages and a minority of the total inlet coolant flow is delivered to the motor, improving the distribution of coolant flow. The embodiments described herein enable relative amounts of coolant flow to be delivered to components of the compressor based on the relative operating temperatures of the components.

Example embodiments of a coolant flow system are described in detail herein. Aspects of the coolant flow system are not limited to the specific embodiments described herein, but rather, components of the coolant flow system may be used independently and separately from other components described herein. For example, in some embodiments, the coolant flow system includes an inlet coolant flow path which splits into a first flow path and a second flow path. The first flow path may be longer than the second flow path, or additionally and/or alternatively, the first flow path may have an outlet that is smaller than an outlet of the second flow path.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

For conciseness, examples will be described with respect to a two-stage centrifugal compressor. However, the methods and systems described herein may be applied to other suitable compressors. The bearings, motor, and other drive components of a compressor may be cooled with vapor injection into the coolant path inlet, by diverting portions of the main flow to the coolant loop connected to a heat exchanger or flash tank.

FIG. 1 is a perspective view of an example two-stage refrigerant compressor 100. The compressor 100 is operable to compress a working fluid (e.g., refrigerant), and includes a compressor housing 102 that forms at least one sealed cavity within which each stage of refrigerant compression is accomplished. The compressor 100 includes a first refrigerant inlet 110 to introduce refrigerant vapor into a first compression stage 124, a first refrigerant exit 114, a refrigerant transfer conduit 112 to transfer compressed refrigerant from the first compression stage 124 to the second compression stage 126, a second refrigerant inlet 118 to introduce refrigerant vapor into the second compression stage 126, and a second refrigerant exit 120. The refrigerant transfer conduit 112 is operatively connected at opposite ends to the first refrigerant exit 114 and the second refrigerant inlet 118, respectively. The refrigerant transfer conduit 112 further includes a port 122 for adding flow between the first and second compression stages 124, 126. The second refrigerant exit 120 delivers compressed refrigerant from a second compression stage 126 to a refrigeration system 200, shown in FIG. 3, in which compressor 100 is incorporated.

Figure 4:
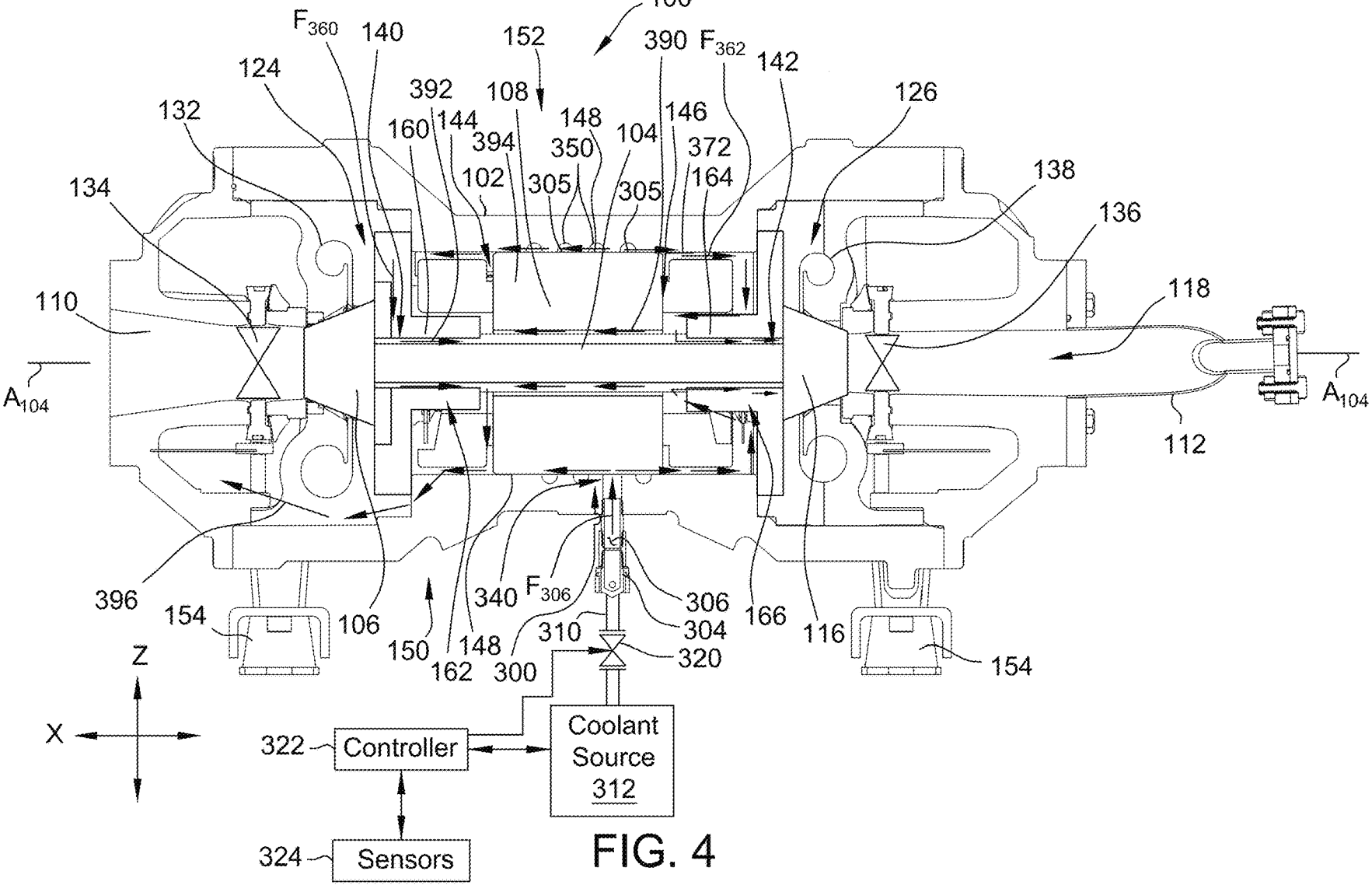
FIG. 4 is a cross-sectional view of the compressor taken along line 4-4 shown in FIG. 1.

Referring to FIG. 4, the compressor housing 102 encloses the first compression stage 124 and the second compression stage 126 at opposite ends of the compressor 100. The first compression stage 124 includes a first impeller 106 configured to add kinetic energy to refrigerant entering via the first refrigerant inlet 110. The kinetic energy imparted to the refrigerant by the first impeller 106 is converted to increased refrigerant pressure as the refrigerant velocity is slowed upon transfer to a sealed cavity (e.g., a diffuser) formed within a volute 132. The first compression stage 124 additionally includes a first variable inlet guide vane (VIGV) 134 disposed upstream of the first impeller 106 in the first refrigerant inlet 110. The first VIGV 134 includes a plurality of vanes whose position can be controlled to introduce pre-swirl into the gaseous refrigerant entering the first refrigerant inlet 110.

Similarly, the second compression stage 126 includes a second impeller 116, configured to add kinetic energy to refrigerant transferred from the first compression stage 124 entering via the second refrigerant inlet 118. The kinetic energy imparted to the refrigerant by the second impeller 116 is converted to increased refrigerant pressure as the refrigerant velocity is slowed upon transfer to a sealed cavity (e.g., a diffuser) formed within a volute 138. Compressed refrigerant exits the second compression stage 126 via the second refrigerant exit 120.

The second compression stage 126 additionally includes a second variable inlet guide vane (VIGV) 136 disposed upstream of the second impeller 116 in the second refrigerant inlet 118. The second VIGV 136 includes a plurality of vanes whose position can be controlled to introduce pre-swirl into the gaseous refrigerant entering the second refrigerant inlet 118.

The first impeller 106 and the second impeller 116 are connected at opposite ends of a shaft 104 which includes a longitudinal axis $A_{104}$ extending between a first shaft end 140 and a second shaft end 142. The shaft 104 is operably connected to a motor 108 (e.g., via magnetic interaction between a rotor and a stator 394). The motor 108 is positioned between the first impeller 106 and the second impeller 116, e.g., generally halfway between the first impeller 106 and the second impeller 116, such that the first impeller 106 and second impeller 116 are rotated at a rotation speed selected to compress the refrigerant to a pre-selected pressure exiting the second refrigerant exit 120. Any suitable motor may be incorporated into the compressor 100 including, but not limited to, an electrical motor. The motor 108 may include a motor temperature sensor (not shown) operable to determine a temperature of the motor 108. The motor temperature sensor may be a thermocouple, thermistor, resistance temperature detector (RTD), or any other suitable sensor.

The shaft 104 is rotatably supported by a first bearing assembly 160, associated with the first compression stage 124 and positioned within a first bearing housing 162, and a second bearing assembly 164, associated with the second compression stage 126 and positioned within a second bearing housing 166. Each of the first and second bearing housings 162, 166 includes a mounting structure for connecting the respective bearing housings to the compressor housing 102. The first and second bearings assemblies 160 and 164 rotationally support the shaft 104 at opposing ends of the shaft 104 with the motor 108 disposed between the first and second bearing assemblies 160 and 164. In some embodiments, the first bearing housing 162 and the second bearing housing 166 may each include radial bearings and/or thrust bearings. In some embodiments, the first bearing assembly 160 and the second bearing assembly 164 may include gas foil bearings.

Figure 3:
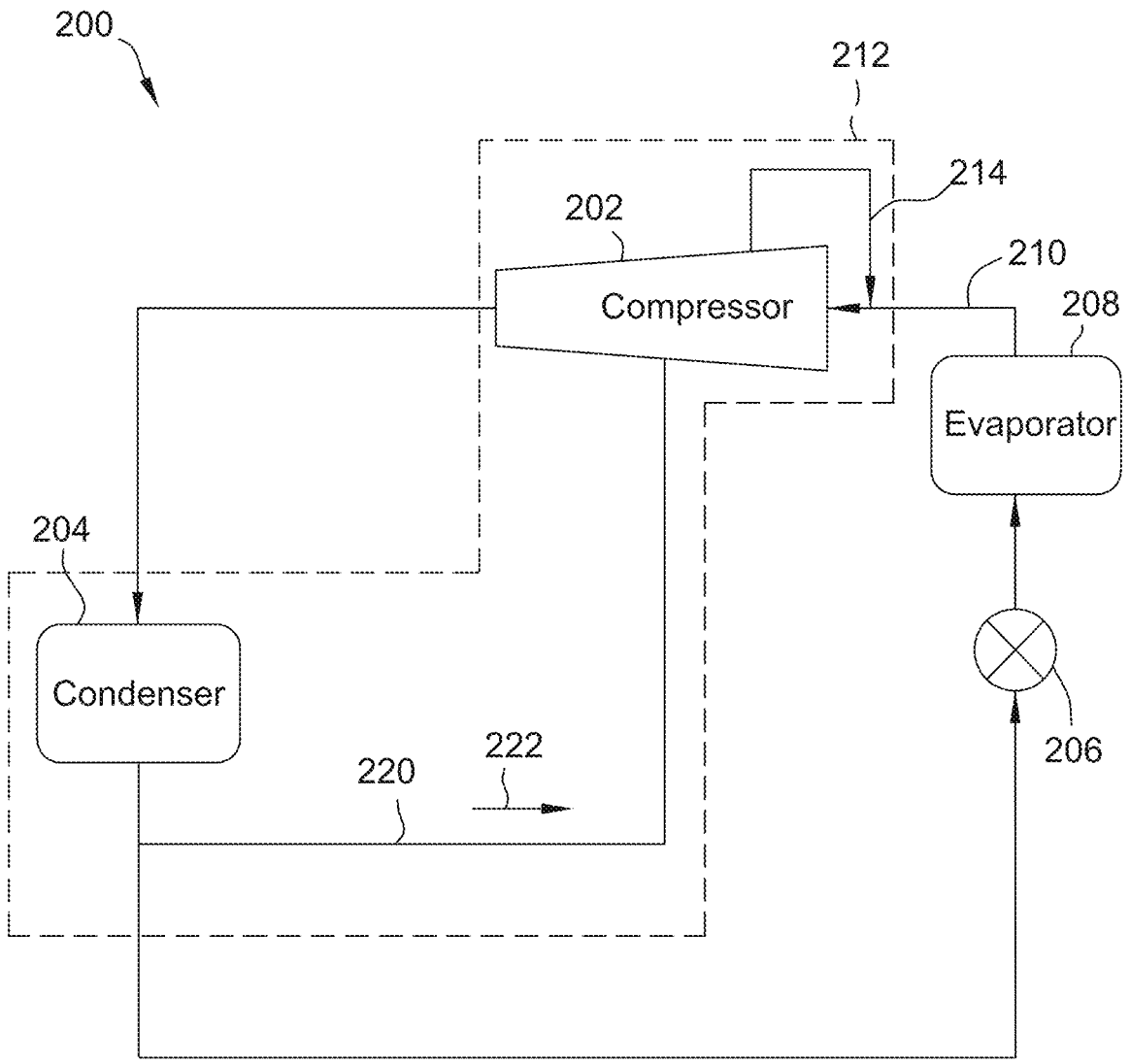
FIG. 3 is a schematic diagram of an example refrigeration system suitable for use with the compressor shown in FIG. 1.

FIG. 3 is a schematic diagram of an example refrigeration system 200 in which the compressor of FIG. 1 can be implemented. The refrigeration system 200 includes a compressor 202, e.g., compressor 100, a condenser 204, an expansion device 206 (e.g., an expansion valve, orifice, capillary tube), and an evaporator 208. The refrigeration system 200 may include additional components or other components than those shown and described with reference to FIG. 3 without departing from the scope of the present disclosure.

In operation, the compressor 202 receives a working fluid, such as a refrigerant, as a low pressure gas through a suction line 210. The compressor 202 compresses the low pressure refrigerant gas, thereby raising the temperature and pressure of the refrigerant. The compressed, high temperature refrigerant exiting the compressor 202 is channeled towards and passes through the condenser 204, where the refrigerant is condensed to a high pressure liquid or a high pressure liquid-gas mixture. The compressed, condensed refrigerant exiting the condenser 204 is channeled towards and passes through the expansion device 206 that expands the refrigerant, thereby reducing the pressure of the refrigerant. The expanded (or "uncompressed") refrigerant exiting the expansion device 206 may be a gas or a mixture of gas and liquid after passing through the expansion device 206. The uncompressed refrigerant exiting the expansion device 206 is channeled towards and passes through the evaporator 208. The uncompressed refrigerant fluid evaporates to a gas in the evaporator 208. The uncompressed refrigerant gas exiting the evaporator 208 is channeled back towards the compressor 202 via the suction line 210, where the working fluid is again compressed and the process repeats.

The example refrigeration system 200 includes a compressor cooling system 212 that draws working fluid (e.g., refrigerant) from part of the main refrigeration circuit (i.e., the refrigeration loop in which the working fluid is compressed using the compressor 202, condensed using the condenser 204, expanded using the expansion device 206, and evaporated using the evaporator 208). The working fluid used in the compressor cooling system 212 is diverted from the main refrigeration circuit and channeled through a coolant supply line 220 towards the compressor 202 to cool components of the compressor 202, such as a motor and bearings of the compressor 202. The working fluid used in the compressor cooling system 212 may also be referred to herein as "coolant" or coolant 222. In some embodiments, between 1-3% of the working fluid is diverted to the coolant supply line 220 to cool components of the compressor 202. The coolant is returned to the refrigeration circuit by a coolant return line 214 (e.g., an internal coolant return line) that channels the coolant towards a low pressure line 220 of the compressor 202 or refrigerant circuit (e.g., suction line 210). As used herein, "low pressure line" of a compressor (e.g., the compressor 202) refers to a refrigerant flow channel within the compressor or the main refrigeration circuit of which the compressor 202 is a part that precedes and channels refrigerant towards one or more impellers in the compression stages of the compressor (e.g., a first stage impeller of the compressor). The low pressure line 220 of the compressor 202 may include, for example and without limitation, a passage extending between an inlet of a first stage of the compressor 202 and a first stage impeller, the first stage inlet of the compressor 202, and the suction line 210 connected to the first stage inlet of the compressor 202.

The coolant used in the cooling system 212 is suitably drawn from a low temperature, high pressure side of the main refrigeration circuit downstream from the condenser 204 and upstream from the expansion device 206 (i.e., from a refrigerant line connected between the condenser 204 and the expansion device 206), or, alternatively, from the condenser 204. Drawing the coolant from the main refrigeration circuit at this stage provides several advantages.

The pressure differential across a cooling circuit 300 of the cooling system 212, i.e., the pressure differential between the high pressure refrigerant exiting the condenser 204 and the low pressure refrigerant entering the compressor 202 via the suction line 210, facilitates driving the coolant through the compressor 202, and back into the refrigeration circuit. The relatively low temperature refrigerant exiting the condenser 204, compared to a temperature of the refrigerant at downstream stages of the main refrigeration circuit (e.g., exiting the evaporator 208 and/or the expansion device 206), facilitates increasing the cooling capacity of the cooling system 212.

Figure 5:
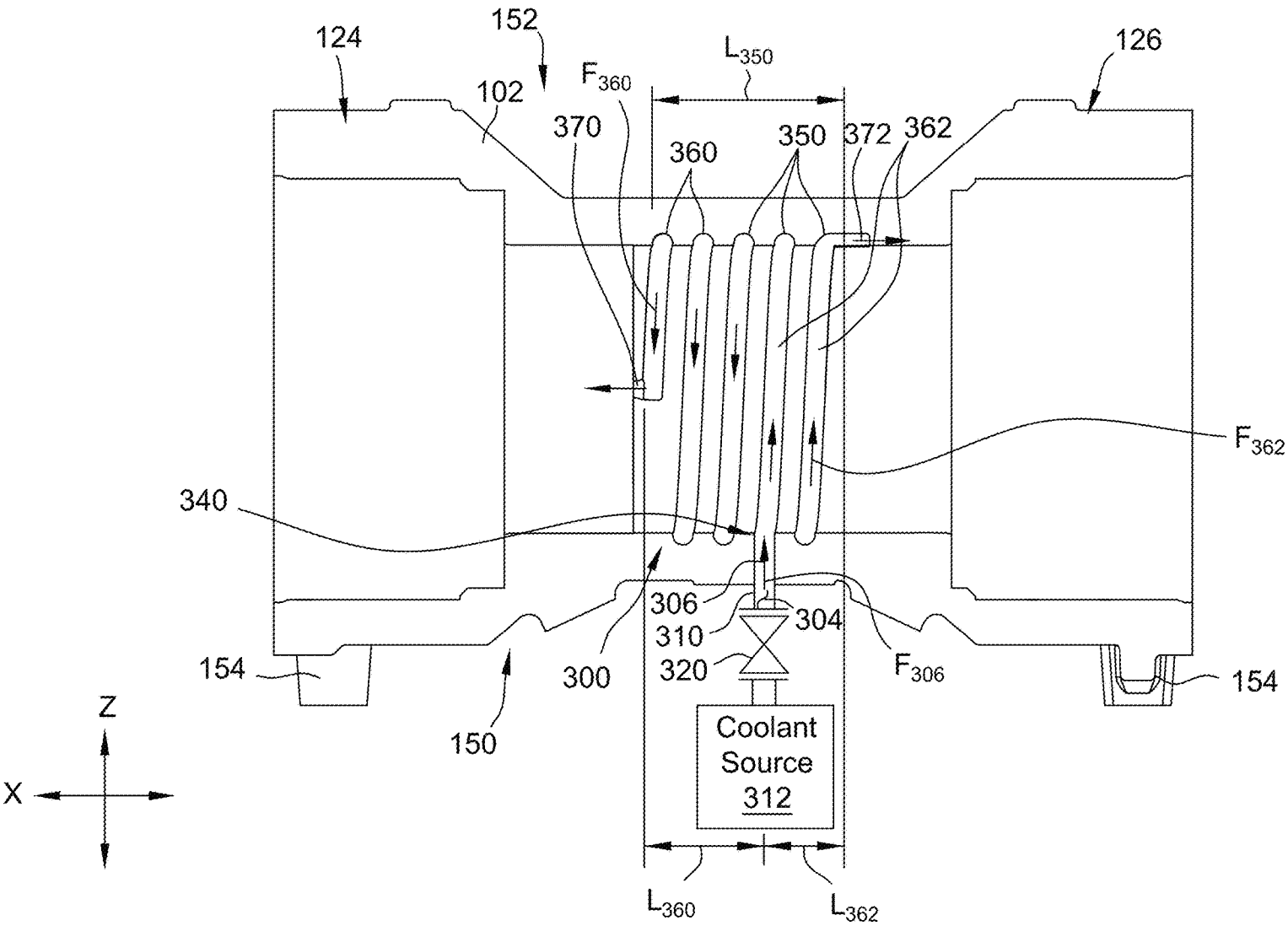
FIG. 5 is a cross-sectional view of a housing of the compressor taken along line 5-5 shown in FIG. 1.

In reference to FIGS. 4 and 5, the compressor cooling system 212 includes a compressor cooling circuit 300 for supplying an inlet coolant flow $F_{306}$ to one or more components of the compressor 100, e.g., to the motor 108, the first bearing assembly 160 of the first compression stage 124 and/or the second bearing assembly 164 of the second compression stage 126. The cooling circuit 300 includes an inlet connection port 304 defined by the compressor housing 102 and extending through a shell thereof, for introducing the coolant flow $F_{306}$ into the cooling circuit 300. The cooling circuit 300 includes a coolant inlet passage 306, connected in fluid communication with the inlet connection port 304. The coolant inlet passage 306 may be, at least partially, formed through the compressor housing 102.

The compressor cooling circuit 300 further includes a coolant supply line 310 for supplying coolant to the inlet connection port 304 from a coolant source 312. In the illustrated embodiment, the coolant source 312 is working fluid, e.g., coolant 222, withdrawn from the refrigeration system 200 via the supply line 220, shown in FIG. 3. The working fluid is drawn from the refrigerant circuit downstream of the condenser 204 in the illustrated embodiment, although the working fluid may be drawn from any suitable portion of the refrigerant circuit that enables the compressor cooling system 212 to function as described herein, such as downstream of the expansion device 206 or from the evaporator 208. In alternative embodiments, the coolant source 312 may be any suitable coolant source for supplying any suitable coolant, e.g., a coolant that is separate from the working fluid.

The compressor cooling circuit 300 includes a flow control device 320, illustrated as a solenoid valve for example, connected to the coolant supply line 310 and/or positioned upstream from the inlet connection port 304 and/or coolant inlet passage 306 for controlling flow of coolant through the cooling circuit 300. The compressor cooling circuit 300 can also include a controller 322 communicatively connected to the flow control device 320. The controller 322 may transmit one or more signals to the flow control device 320 to adjust a flow parameter, e.g., velocity, mass flow rate, or pressure, etc., of the coolant supplied to the inlet connection port 304. In other words, flow control device 320 controls a flow parameter of inlet coolant flow $F_{306}$.

In some embodiments, the compressor cooling circuit 300 may include one or more coolant sensors 324, communicatively connected to controller 322, for detecting a parameter of the coolant, e.g., a pressure sensor, a temperature sensor, and/or a velocity sensor and the like. In some embodiments, the controller 322 may utilize the received sensor data to determine one or more control signals to be transmitted to the flow control device 320, e.g., to adjust a parameter of the coolant.

Additionally, and/or alternatively, the compressor 100 and/or the compressor cooling circuit 300 further includes one or more compressor sensors, communicatively coupled to the controller 322, for detecting a parameter of the compressor 100. For example, in some embodiments, the compressor 100 includes temperature sensors (not shown) operable to determine a temperature of the motor 108, the first bearing assembly 160, the second bearing assembly 164, and/or any other suitable component of the compressor 100.

The inlet connection port 304 and the coolant inlet passage 306 may be positioned axially between the first impeller 106 and the second impeller 116, and/or axially between the first bearing housing 162 and the second bearing housing 166. The inlet connection port 304 and the inlet passage 306 may be generally positioned axially between a first axial end 144 and a second axial end 146 of the motor 108. In some embodiments, the inlet connection port 304 and the coolant inlet passage 306 are positioned axially closer to the second bearing assembly 164 and/or the second impeller 116 than the first bearing assembly 160 and/or the first impeller 106. In some embodiments, the inlet connection port 304 and coolant inlet passage 306 are arranged on a bottom or lower side 150, opposite of an upper side 152, of the compressor 100. For example, the inlet connection port 304 and coolant inlet passage 306 may be positioned on the same side of the compressor 100 as feet or mounting supports 154 of the compressor 100. The coolant inlet passage 306 may extend generally along a direction Z that is generally perpendicular to the horizontal axis X that is parallel to the longitudinal axis $A_{104}$ of the shaft 104.

Figure 6:
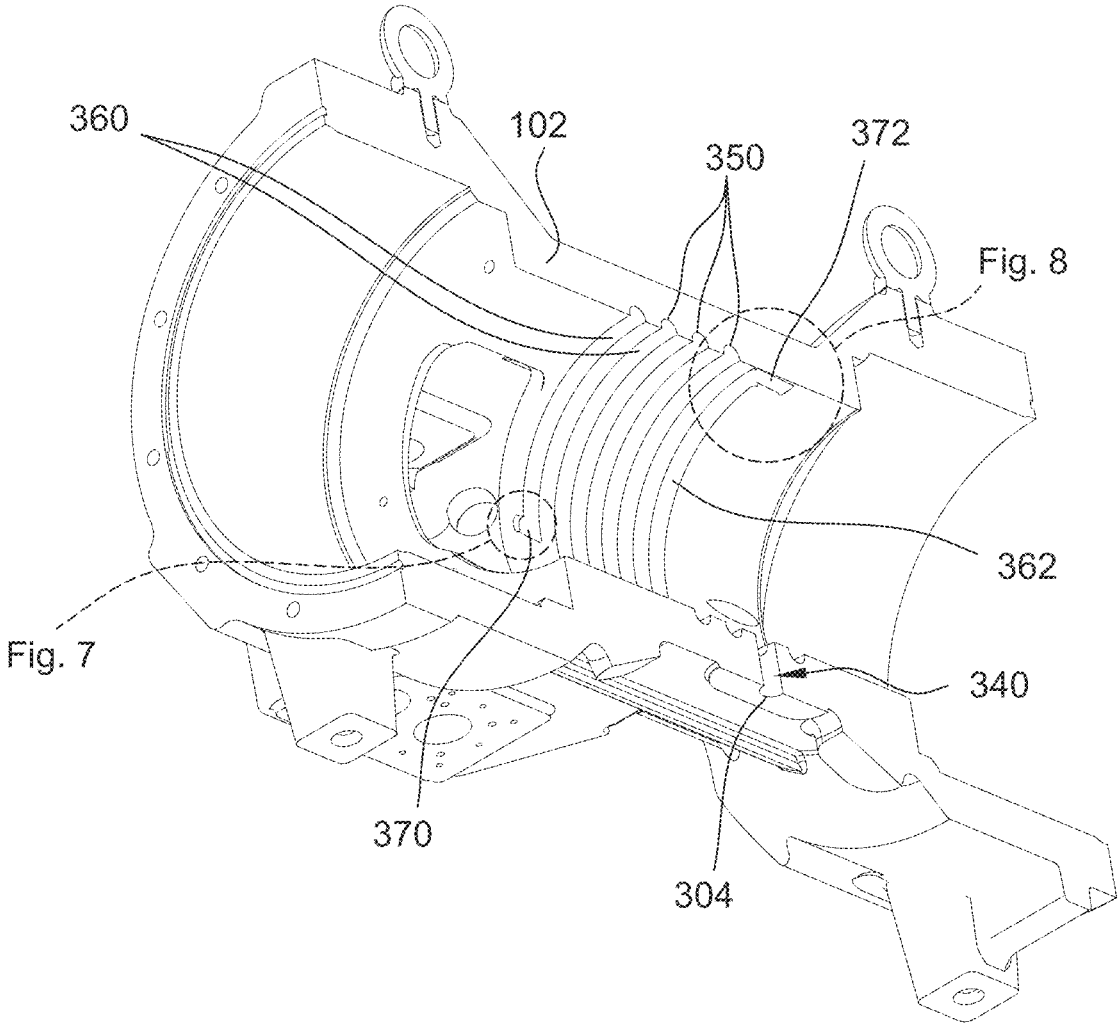
FIG. 6 is a perspective cut-away view of the housing shown in FIG. 5.

In further reference to FIGS. 5 and 6, the cooling circuit 300 further includes a cooling channel 350 connected in fluid communication with the inlet connection port 304 and/or the coolant inlet passage 306. The cooling channel 350 of the illustrated embodiment is defined in the compressor housing 102 and wraps or extends helically around the motor 108 (e.g., the stator 394 of the motor 108). More specifically, the cooling channel 350 is defined along an inner surface of the compressor housing 102, such as a radial inner surface of a shell of the compressor housing 102. The cooling channel 350 is open to and in communication with the interior cavity of the compressor housing 102 and the motor 108 (e.g., the stator 394 of the motor 108), when installed in the compressor housing 102. Moreover, when the compressor 100 is assembled, the motor 108 forms an inner boundary 305 of the cooling channel 350, as shown in FIG. 4. For example, an outer surface 148 of the motor 108 (e.g., the stator 394 of the motor 108), forms the inner boundary 305. The cooling channel 350 extends helically along the direction of the horizontal axis X and along the direction of longitudinal axis $A_{104}$ of the shaft 104 for an overall, or total, axial length $L_{350}$. The overall axial length $L_{350}$ of the cooling channel 350 may be generally the same length as an axial length of the motor 108 (e.g., the stator 394 of the motor 108).

The cooling channel 350 includes a first branch or portion 360 and a second branch or portion 362, each emanating or extending from the coolant inlet passage 306, and/or the inlet connection port 304, such that the inlet coolant flow $F_{306}$ is split or divided between the first and second portions 360, 362. The first portion 360 extends from the coolant inlet passage 306, and/or the inlet connection port 304, to a first outlet 370, and extends from the inlet connection port 304 in the direction of the first impeller 106 and/or the first bearing housing 162 (i.e., towards the first compression stage 124). The second portion 362 extends from the coolant inlet passage 306, and/or the inlet connection port 304, to a second outlet 372, and extends from the inlet connection port 304 in the direction of the second impeller 116 and/or the second bearing housing 166 (i.e., towards the second compression stage 126). Each of the first portion 360 and the second portion 362 includes a respective axial length $L_{360}$ and $L_{362}$, which sum to the overall axial length $L_{350}$ of the cooling channel 350.

The first portion 360 and the second portion 362 also include respective first and second lengths. The first and second lengths refer to a path length of the respective first or second portion 360 or 362, that is, the length fluid travels along the respective first or second portion 360 or 362. In embodiments with a helical cooling channel 350, as in the illustrated embodiment, the first and second lengths can be determined using the equation π*(number of turns)*(outer diameter-inner diameter)/2. In some embodiments, the first portion 360 and the second portion 362 have the same number of turns per axial length, such that the cooling channel 350 has a uniform helical winding along the overall axial length $L_{350}$. In some alternative embodiments, the first portion 360 and the second portion 362 have a different number of turns per axial length. For example, the first portion 360 may have a greater number of turns per axial length than the second portion 362. Alternatively, the second portion 362 may have a greater number of turns per axial length than the first portion 360.

The first portion 360 and the second portion 362 each have a respective cross-sectional area $A_{360}$ and $A_{362}$. Shown in FIGS. 7 and 8. In the illustrated embodiment, the cross-sectional areas $A_{360}$ and $A_{362}$ are substantially constant along their entire respective lengths, and they are substantially the same. For example, the cross-sectional areas $A_{360}$ and $A_{362}$ may vary by between 5% to 10% from each other. Alternatively, the cross-sectional areas $A_{360}$ and $A_{362}$ can be different. For example, the cross-sectional area $A_{360}$ of the first portion 360 can be less than the cross-sectional area $A_{362}$ of the second portion 362, or the cross-sectional area $A_{362}$ of the second portion 362 can be less than the cross-sectional area $A_{360}$ of the first portion 360. In the illustrated embodiment, the cross-sectional areas $A_{360}$ and $A_{362}$ are generally semi-circular in shape, although the cross-sectional areas $A_{360}$ and $A_{362}$ may have any suitable cross-sectional shape that enables the compressor cooling circuit 300 to function as described herein.

The inlet coolant flow $F_{306}$ is introduced into the cooling channel 350 through the single coolant inlet passage 306 and/or the single inlet connection port 304. For example, the coolant inlet passage 306 and/or the inlet connection port 304 are the only coolant inlet passages and/or the only inlet connection ports. The coolant inlet passage 306 connects to the cooling channel 350 generally perpendicularly to the cooling channel 350, such that the cooling circuit 300 includes a generally U-shaped, Y-shaped or T-shaped split 340. The split 340 divides the inlet coolant flow $F_{306}$ into a first coolant flow $F_{360}$, directed into the first portion 360, and a second coolant flow $F_{362}$, directed into the second portion 362.

The first coolant flow $F_{360}$ flows through the first portion 360 in a first direction and the second coolant flows $F_{362}$ through the second portion 362 in a second direction, opposite the first direction. For example, the first coolant flow $F_{360}$ may flow through the first portion 360 in a clockwise direction and the second coolant flow $F_{362}$ flows through the second portion 362 in a counterclockwise direction.

The first outlet 370 releases the first coolant flow $F_{360}$ from the first portion 360 to, or in proximity to, the first compression stage 124, e.g., the first bearing housing 162, the first impeller 106 and/or first shaft end 140. The second outlet 172 releases the second coolant flow $F_{362}$ from the second portion 362 to the second compression stage 126, e.g., the second bearing housing 166, the second impeller 116, and/or the second shaft end 142.

Figure 7:
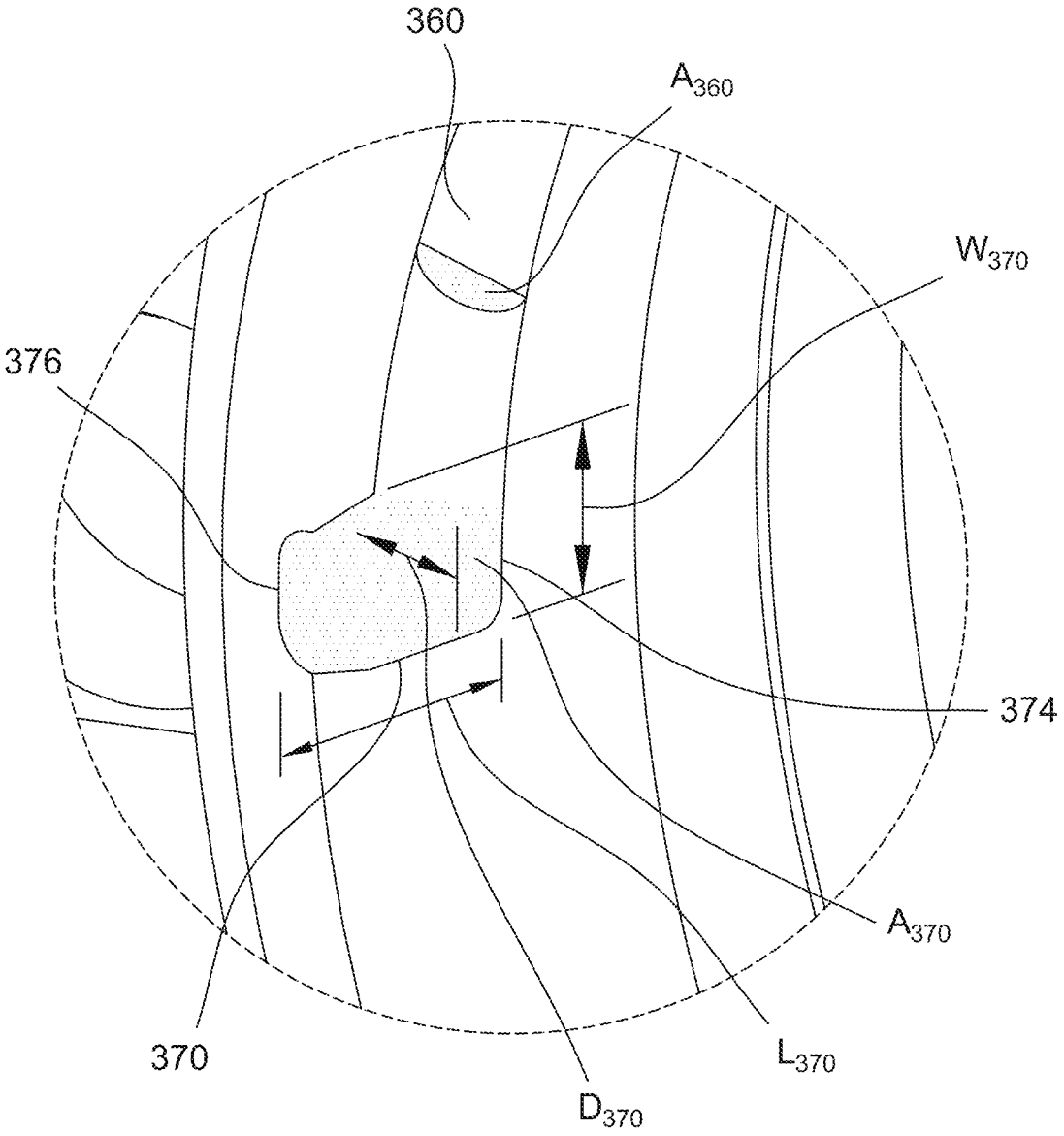
FIG. 7 is an enlarged view of a portion of the housing indicated by "FIG. 7" in FIG. 6.
Figure 8:
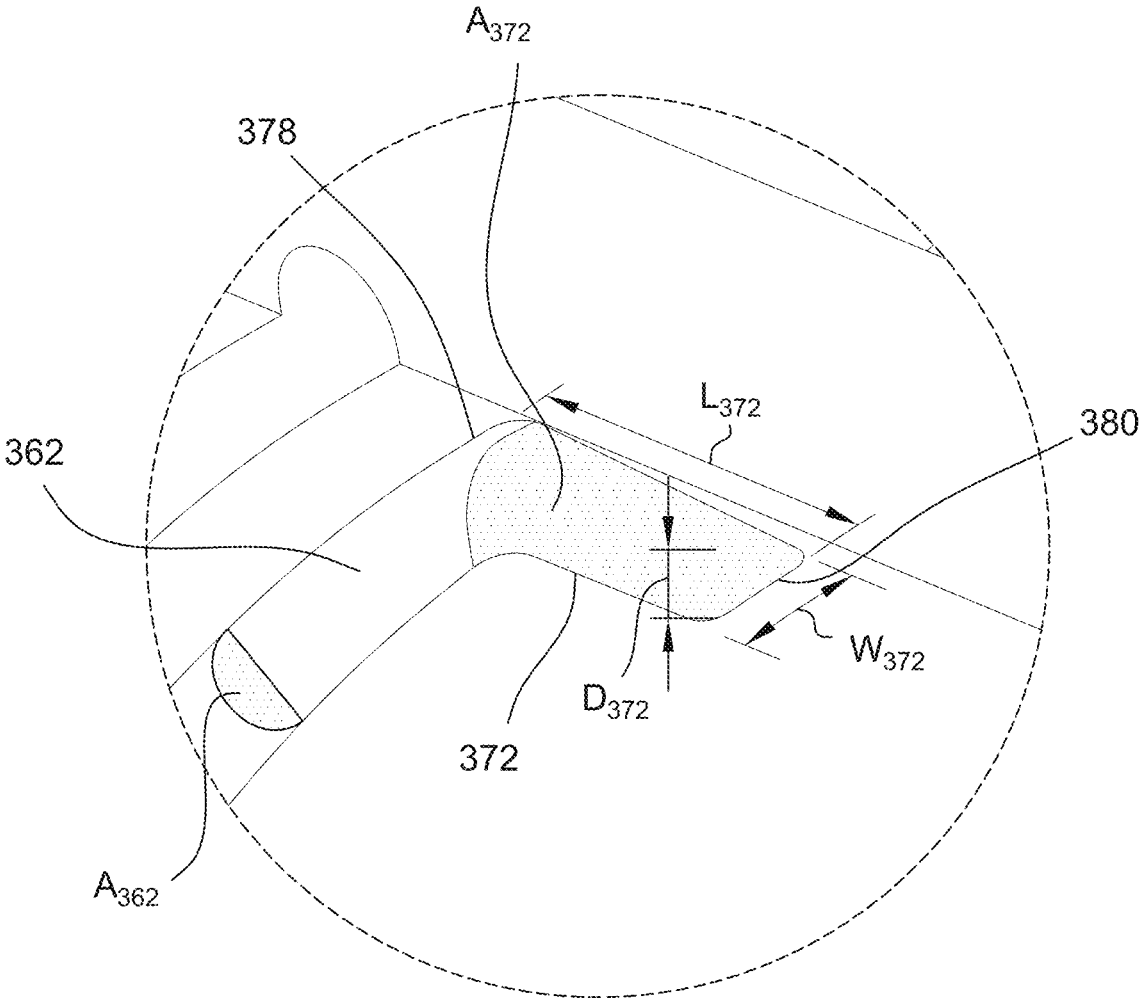
FIG. 8 is an enlarged view of a portion of the housing indicated by "FIG. 8" in FIG. 6.

In reference to FIGS. 7-8, each of the first outlet 370 and the second outlet 372 includes a first outlet area $A_{370}$ and a second outlet area $A_{372}$, respectively. In the illustrated embodiment, the second outlet area $A_{372}$ is greater than the first outlet area $A_{370}$. In other embodiments, the second outlet area $A_{372}$ can be less than the first outlet area $A_{370}$, or the first and second outlet areas $A_{370}$, $A_{372}$ can be the same. The first outlet 370 includes a length $L_{370}$, extending between a first axial end 374 and a second axial end 376 and a width $W_{370}$, and the second outlet 372 includes a length $L_{372}$, extending between a first axial end 378 and a second axial end 380 and a width $W_{372}$. In the illustrated embodiment, length $L_{370}$ is shorter than length $L_{372}$. In other embodiments, length $L_{370}$ can be longer than length $L_{372}$, or lengths $L_{370}$, $L_{372}$ can be the same.

In the illustrated embodiment, the width $W_{370}$ and the width $W_{372}$ are substantially the same, although the width $W_{370}$ can be greater than or less than the width $W_{372}$ in other embodiments. The first outlet 370 and the second outlet 372 each include a respective outlet depth $D_{370}$ and $D_{372}$. In the illustrated embodiment, outlet depth $D_{370}$ and outlet depth $D_{372}$ are substantially the same, although outlet depth $D_{370}$ can be greater than or less than outlet depth $D_{372}$ in other embodiments.

In further reference to FIGS. 4 and 5, in some embodiments, the first and second outlets 370 (not visible in FIG. 4), 372 are axially aligned with the first axial end 144 and the second axial end 146 of the motor 108 (e.g., the stator 394 of the motor 108), respectively. For example, the first axial end 144 may be aligned between the first and second axial ends 376 and 374 of the first outlet 370 and the second axial end 146 may be aligned between the first and second axial ends 378 and 380 of the second outlet 372. In some embodiments, the first and second outlets 370, 372 are positioned axially outside of the motor 108 (e.g., the stator 394 of the motor 108). The first and second outlets are positioned to release the first coolant flow $F_{360}$ and the second coolant flow $F_{362}$ axially outside of the motor 108 (e.g., the stator 394 of the motor 108).

The first and second outlets 372, 370 may have different radial positions. For example, the first outlet 370 has a radial position generally aligned with the upper side 152 of the compressor 100 and the second outlet 372 is radially offset from the first outlet 370 by approximately 90°. In some embodiments, the second outlet 372 may be radially offset from the first outlet 370 by between 45-120°.

In embodiments described herein, the compressor cooling circuit 300 includes a single inlet connection port 304, and a single coolant inlet passage 306, such that only a single supply line 310 can be used to supply coolant to cooling circuit 300 to deliver coolant to multiple components of the compressor 100. The single inlet connection port 304 reduces installation times and costs as only a single coolant supply line 310 needs to be connected to the inlet connection port 304. In addition, the single inlet connection port 304 allows a single flow control device 320 to regulate flow of coolant delivered to the inlet connection port 304. Furthermore, the single inlet connection port 304 and single coolant supply line 310 can reduce the overall footprint and simplify inspection and maintenance of the compressor, which is particularly advantageous for consumers or end users of the compressor.

Embodiments of the compressor cooling circuit 300 selectively distribute coolant throughout the compressor requiring only a single flow control device 320. For example, one or more structural features of the first portion 360 and the second portion 362 result in coolant being selectively distributed between the first portion 360 and the second portion 362. For example, one or more structural features of the first portion 360 and the second portion 362 can be designed to selectively and passively control an amount and/or a flow rate of the first coolant flow $F_{360}$ exiting the first outlet 370 of the first portion 360 and the amount and/or flow rate of the second coolant flow $F_{362}$ exiting the second outlet 372 of the second portion 362. In embodiments described herein, the features are passive features, e.g., structural elements, such that coolant flow is distributed between the first outlet 370 and the second outlet 372, without requiring additional flow control devices and/or complex control systems and associated algorithms.

In the example embodiment, structural features of the first portion 360 and the second portion 362 result in coolant being preferentially directed to the second portion 362 and out of the second outlet 372 as compared to the amount or flow rate of coolant directed to the first portion 360 and out of the first outlet 370. For example, a second amount and/or a second flow rate of the second coolant flow $F_{362}$ exiting the second outlet 372 is greater than a first amount and/or a first flow rate of the first coolant flow $F_{360}$ exiting the first outlet 370. In some embodiments, for example, structural features of the first portion 360 and the second portion 362 result in the inlet coolant flow $F_{350}$ being split such that the second coolant flow $F_{362}$ flowing through the second portion 362 is 55-60% of the inlet coolant flow $F_{350}$ and the first coolant flow $F_{360}$ flowing through the first portion 360 is 40-45% of the inlet coolant flow $F_{350}$. In some embodiments, structural features of the first portion 360 and the second portion 362 result in the second flow rate of $F_{362}$, flowing through the second portion 362 or exiting the second outlet 372, to be greater than the first flow rate of $F_{360}$, flowing through the first portion 360 or exiting the first outlet 370. In some embodiments, the second flow rate may be between 45-55%, between 40-60%, or between 49-51% greater than the first flow rate.

The first portion 360 and the second portion 362 each includes a flow resistance value or coefficient, which represents or is associated with a resistance to fluid flow along the respective first or second portion 360, 362. A higher flow resistance coefficient is associated with reduced flow rates or amounts of coolant flow, and a lower flow resistance coefficient is associated with higher flow rates or amounts of coolant flow.

As will be understood by those skilled in the art, the flow resistance coefficient is largely a function of channel geometry and construction, in particular channel length, channel cross-sectional area and/or diameter, the friction coefficient of the surfaces defining the channel, and outlet size and shape, etc. For example, for a channel with a fixed cross-sectional area, a shorter flow path length and/or a larger outlet would result in a lower flow resistance. Similarly, a higher flow resistance coefficient may be associated with a longer flow path length and/or a smaller outlet. The flow resistance coefficient may be determined using various equations for calculating flow rate or, alternatively, the flow resistance coefficient may be determined empirically, e.g., during a calibration or design process. Moreover, in the context of the present disclosure, the relative flow resistance coefficients of the first portion 360 and the second portion 362 can be used as a proxy to evaluate the relative flow rates of coolant flow along the first portion 360 and the second portion 362, and the resulting amount of coolant delivered along the first portion 360 and the second portion 362. Flow resistance coefficients of the first portion 360 and the second portion 362 can therefore be determined or analyzed independently of operational characteristics of the compressor 100 (e.g., pressure differentials, specific gravity of refrigerants, etc.) to evaluate relative flow rates and/or amounts along the first portion 360 and the second portion 362.

The first portion 360 includes a first flow resistance coefficient that is different than a second flow resistant coefficient of the second portion 362. As noted above, the first flow resistance coefficient is inversely related to the amount and/or flow rate of first coolant flow $F_{360}$ exiting the first outlet 370. Similarly, the second resistance coefficient is inversely related to the amount and/or the flow rate of the second coolant flow $F_{362}$ exiting the second outlet 372. In the illustrated embodiment, the first flow resistance coefficient is greater than the second flow resistance coefficient. For example, the first portion 360 may have a greater first length compared to the second portion 362, a smaller cross-sectional area $A_{360}$ compared to area $A_{362}$, a smaller outlet area $A_{370}$ compared to outlet area $A_{372}$, a greater friction coefficient compared to a friction coefficient of the second portion 362, a greater number of turns per unit length compared to a number of turns per unit length of the second portion 362, a greater flow path volume (cross-sectional area*length), or any combination thereof. As a result, the flow rate and/or amount of coolant delivered along the first portion 360 (and consequently, to the first compression stage 124) is less than the flow rate and/or amount of coolant delivered along the second portion 362 (and consequently, to the second compression stage 126).

In further reference to FIG. 4, after the first coolant flow $F_{360}$ exits the first outlet 370, not visible in FIG. 4, the first coolant flow $F_{360}$ flows within the compressor housing 102 towards the first bearing housing 162, around the first bearing assembly 160, e.g., between the first bearing assembly 160 and the shaft 104. After the second coolant flow $F_{362}$ exits the second outlet 372 the second coolant flow $F_{362}$ flows within the compressor housing 102 towards the second bearing housing 166, around the second bearing assembly 164, e.g., between the second bearing assembly 164 and the shaft 104.

In embodiments described herein the first coolant flow $F_{360}$ is directly delivered to the first bearing housing 162 upon exiting the first outlet 370. For example, the first coolant flow $F_{360}$ is not used to cool other components of the compressor 100 prior to being delivered to the first bearing housing 162. In addition, in some embodiments described herein, the first coolant flow $F_{360}$ is released in proximity to the first bearing housing 162, as such the first coolant flow $F_{360}$ does not travel through other components of the compressor 100 prior to reaching the first bearing housing 162.

In embodiments described herein the second coolant flow $F_{362}$ is directly delivered to the second bearing housing 166 upon exiting the second outlet 372. For example, the second coolant flow $F_{362}$ is not used to cool other components of the compressor 100 prior to being delivered to the second bearing housing 166. In addition, in some embodiments described herein, the second coolant flow $F_{362}$ is released in proximity to the second bearing housing 166, as such the second coolant flow $F_{362}$ does not travel through other components of the compressor 100 prior to reaching the second bearing housing 166.

The refrigeration system 200 includes a return coolant flow path 396 which returns both the first coolant flow $F_{360}$ and the second coolant flow $F_{362}$ after these flows have cooled the first and second bearings 160, 164, respectively. The return flow path includes a first return flow path 392 after cooling the first bearing assembly 160 and a second return flow path 390 returning from the second bearing assembly 164 and traveling along the shaft 104 through the motor 108 e.g., the stator 394 of the motor 108). The return coolant flow path 390 may include a return passage 396 for returning the return flow path 392 and 390 to the first compression stage 124.

Figure 9:
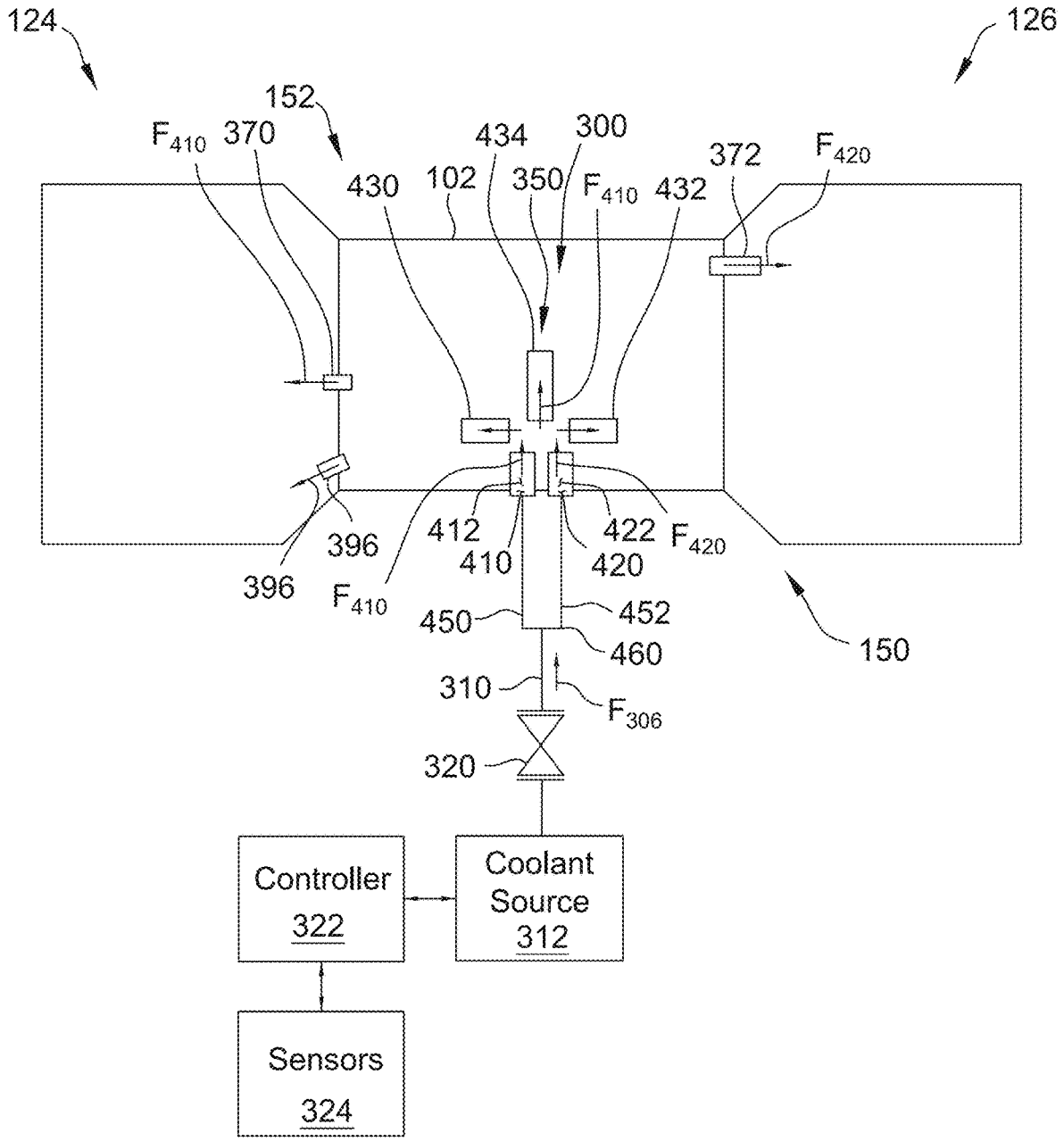
FIG. 9 is a cross-sectional view of a housing of another compressor taken along line 5-5 shown in FIG. 1.

In reference to FIG. 9, in some embodiments, the cooling circuit 300 includes a plurality of the inlet connection ports 304 defined by the compressor housing 102 and a plurality of the coolant inlet passages 306 connected in fluid communication with one of the plurality of inlet connection ports 304. For example, the cooling circuit 300 may include a first inlet connection port 410 fluidly connected to a first coolant inlet passage 412 for introducing a first coolant flow $F_{410}$ into the cooling circuit 300, and a second inlet connection port 420 fluidly connected to a second coolant inlet passage 422 for introducing a second coolant flow $F_{420}$ into the cooling circuit 300.

In the embodiment illustrated in FIG. 9, the first and second coolant inlet passages 412, 422 are fluidly connected to the cooling channel 350 that extends helically around the motor 108. In the embodiment illustrated in FIG. 9, the cooling channel 350 includes a first portion 430, a second portion 432, and a third portion 434 extending therebetween. The first portion 430 extends from the first coolant inlet passage 412 to the first outlet 370 and the second portion 432 extends from the second coolant inlet passage 422 to the second outlet 372. The third portion 434 extends between and fluidly connects the first coolant inlet passage 412 and the second coolant inlet passage 422.

In some embodiments, a portion of the first coolant flow $F_{410}$ and a portion of the second coolant flow $F_{420}$ may flow into the third portion 434 combining to form a third coolant flow $F_{434}$. The third coolant flow $F_{434}$ may have a low flow rate forming a near stationary pocket of coolant within the third portion 434. In some cases, the third coolant flow $F_{434}$ may flow towards the second portion 432. In some cases, the third coolant flow $F_{434}$ may flow towards the first portion 430. In the illustrated embodiment, a majority of the first coolant flow $F_{410}$ flows through the first portion 430 and exits the first outlet 370 to deliver a majority of the first coolant flow $F_{410}$ to the first bearing assembly 160 and a majority of the second coolant flow $F_{420}$ flows through the second portion 432 and exits the second outlet 372 to deliver a majority of the second coolant flow $F_{420}$ to the second bearing assembly 164. To put it differently, only a minor portion of the first and second coolant flow $F_{410}$, $F_{420}$ is diverted into the third portion 434. The third portion 434 is axially positioned in alignment with the motor 108 for cooling components of the motor 108. The third portion 434 may be shorter than either, or both, of the first portion 430 and the second portion 432. In some embodiments, the third portion 434 includes a single channel turn, or less than a single channel turn. In the illustrated embodiment, cooling of the compressor 100 is improved as the amount of the third coolant flow $F_{434}$ is less than either of the amounts of the first and second coolant flows $F_{410}$, $F_{412}$ flowing through the respective first and second portions 430, 432 such that a majority of the total inlet coolant flow $F_{306}$ is delivered to the first and second bearing assemblies 160 and 164 and less, or a minority, of the total inlet coolant flow $F_{306}$, e.g., the third coolant flow $F_{464}$, is delivered to cool components of the motor 108.

In some embodiments, the length of the first portion 430 and the second portion 432 are approximately the same. In some embodiments, the first portion 430 and the second portion 432 may include the same number of channel turns around the motor 108. In some embodiments, the length of the second portion 432 is longer than a length of the first portion 430. In some alternative embodiments, the second portion 432 includes more channel turns around the motor 108 than that of the first portion 430. In some alternative embodiments, the length of the first portion 430 is longer than a length of the second portion 432. In some alternative embodiments, the first portion 430 includes more channel turns around the motor 108 than that of the second portion 432.

In the illustrated embodiment, the placement of the first inlet connection port 410 and the first coolant inlet passage 412, relative to the first outlet 370, shortens a distance of the first portion 430 causing coolant fluid flow, e.g., a majority of the first coolant flow $F_{430}$, to be delivered to the first bearing assembly 160 sooner. For example, the first coolant inlet passage 412 is positioned closer to the first outlet 270 compared to the second coolant inlet passage 422. Similarly, the placement of the second inlet connection port 420 and the second coolant inlet passage 422 relative to the second outlet 372, shortens a distance of the second portion 432 causing coolant fluid flow, e.g., a majority of the second coolant flow $F_{432}$, to be delivered to the second bearing assembly 164 sooner. For example, the second coolant inlet passage 422 is positioned closer to the second outlet 372 compared to the first coolant inlet passage 412. Each of the first and second coolant inlet passages 412, 422 are fluidly connected to the coolant source 312 by respective first and second coolant supply lines 450, 452 disposed external to the compressor housing 102. In some embodiments, a length of the first coolant supply line 450 may be different than a length of the second coolant supply line 452. In some embodiments, a length of the first coolant supply line 450 is approximately the same as a length of the second coolant supply line 452. In some embodiments, the supply line 310 is fluidly connected to a split 460 which divides the total inlet coolant flow $F_{306}$ between the first coolant supply line 450 and the second coolant supply line 452.

The relative lengths of the first and second coolant supply lines 450, 452 may be selected during installation, e.g., by a customer or technician tasked with installing the compressor 100, which may contribute to the overall resistance of the first and second portions 430, 432. The dual inlet connection ports 410, 420, their arrangement relative to the first and second outlets 370, 372, and the formation of the third coolant flow $F_{434}$ within the third portion 434, will mitigate discrepancies in customer or user selected supply line lengths by delivering a majority of the coolant inlet supply to the first and second bearing assemblies 160, 164.

The flow control device 320 may be positioned upstream from either, or both, of the first and second inlet connection ports 410, 420 for controlling flow of coolant through the cooling circuit 300. For example, the flow control device 320 may be connected to the coolant supply line 310 upstream from the split 460 and upstream from both the first coolant supply line 450 and the second coolant supply line 452. In some alternative embodiments, the cooling circuit 300 is fluidly connected with one or more of the flow control devices 320. For example, in some alternative embodiments, the cooling circuit 300 includes a first of the flow control devices 320 fluidly connected to the first coolant supply line 450 and a second of the flow control devices 320 fluidly connected with the second coolant supply line 452.

The first portion 430, the second portion 432, and the third portion 434 each includes a flow resistance value or coefficient, which represents or is associated with a resistance to fluid flow along the respective first, second, and third portions 430, 432, and 434. As described above, a higher flow resistance coefficient is associated with reduced flow rates or amounts of coolant flow, and a lower flow resistance coefficient is associated with higher flow rates or amounts of coolant flow and the flow resistance coefficient is largely a function of channel geometry and construction, in particular channel length, channel cross-sectional area and/or diameter, the friction coefficient of the surfaces defining the channel, and outlet size and shape, etc.

In some embodiments, the first portion 430 includes a first flow resistance coefficient that is approximately the same as a second flow resistant coefficient of the second portion 432. In some embodiments, the first flow resistance coefficient is different than the second flow resistant coefficient. For example, the first flow resistance coefficient may be greater than the second flow resistance coefficient. For example, the first portion 430 may have a greater length compared to the second portion 432, a smaller cross-sectional area, a smaller outlet area $A_{370}$ compared to outlet area $A_{372}$, a greater friction coefficient compared to a friction coefficient of the second portion 432, a greater number of turns per unit length compared to a number of turns per unit length of the second portion 432, a greater flow path volume (cross-sectional area*length), or any combination thereof. As a result, the flow rate and/or amount of coolant delivered along the first portion 430 (and consequently, to the first compression stage 124) is less than the flow rate and/or amount of coolant delivered along the second portion 432 (and consequently, to the second compression stage 126).

For example, structural features of the first portion 430, the second portion 432, and the third portion 434 result in a majority of the inlet coolant flow $F_{306}$ to flow through the second portion 432. In some embodiments, structural features of the first portion 430, the second portion 432, and the third portion 434 causes 60%-50% of a total inlet coolant flow $F_{306}$ (e.g., the total coolant flow delivered to the cooling circuit 300) to flow along the second portion 432 and 40%-50% of the total inlet coolant flow $F_{306}$ to flow along the first portion 430. In some embodiments, structural features of the first portion 430, the second portion 432, and the third portion 434 causes 558-45% of the total inlet coolant flow $F_{306}$ to flow along the second portion 432 and 45%-55% of the total inlet coolant flow $F_{306}$ to flow along the first portion 430. In some embodiments, structural features of the first portion 430, the second portion 432, and the third portion 434 causes 50% of the total inlet coolant flow $F_{306}$ to flow along the second portion 432 and 50% of the total inlet coolant flow $F_{306}$ to flow along the first portion 430.

In some embodiments, structural features of the first portion 430, the second portion 432, and the third portion 434 result in the second flow rate of $F_{420}$, flowing through the second portion 432 or exiting the second outlet 372, to be greater than the first flow rate of $F_{410}$, flowing through the first portion 430 or exiting the first outlet 370.

The first and second inlet connection ports 410, 420 and the first and second coolant inlet passages 412, 422 are both arranged on a bottom or lower side 150, opposite of the upper side 152, of the compressor 100. The first and second inlet connection ports 410, 420 may be arranged in close proximity, e.g., spaced axially apart by 20 to 30 mm. The relative position of the first and second inlet connection ports 410, 420 improves installation processes by enabling shorter coolant supply lines 450, 452 that only need to be connected to one side of the compressor 100.

When introducing elements of the present disclosure or the embodiment(s) thereof, the articles "a," "an," "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top," "bottom," "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A compressor system comprising:

a compressor housing;

a shaft rotationally supported by a first bearing and a second bearing within the compressor housing;

a first impeller operably connected to the shaft at a first end of the shaft;

a second impeller operably connected to the shaft at a second end of the shaft;

a motor operably connected to the shaft between the first bearing and the second bearing; and a cooling circuit comprising:

a coolant inlet passage defined by the compressor housing for introducing an inlet coolant flow into the cooling circuit; and a cooling channel defined by the compressor housing and connected in fluid communication with the coolant inlet passage, wherein the cooling channel extends helically around the motor and includes a first portion and a second portion, wherein each of the first portion and the second portion extends from the coolant inlet passage to respective first and second outlets such that the inlet coolant flow is split into a first coolant flow along the first portion and a second coolant flow along the second portion, wherein a flow rate of the second coolant flow is greater than a flow rate of the first coolant flow.

2. The compressor system of claim 1, wherein 55%-60% of the inlet coolant flow flows along the second portion and 40%-45% of the inlet coolant flow flows along the first portion.

3. The compressor system of claim 1, wherein a length of the first portion is greater than a length of the second portion.

4. The compressor system of claim 1, wherein a length of the first portion is between 55-65% of a total length of the cooling channel.

5. The compressor system of claim 1, wherein each of the first portion and the second portion includes a number of channel turns around the motor, and wherein the first portion includes more channel turns than the second portion.

6. The compressor system of claim 5, wherein a first outlet area of the first outlet is smaller than a second outlet area of the second outlet.

7. The compressor system of claim 5, wherein a second outlet area of the second outlet is at least 50% greater than a first outlet area of the first outlet.

8. The compressor system of claim 1, wherein the coolant inlet passage is the only coolant inlet passage of the cooling circuit.

9. The compressor system of claim 1, wherein coolant flow exiting the first outlet is delivered to the first bearing and the coolant flow exiting the second outlet is delivered to the second bearing.

10. A compressor system comprising:

a compressor housing;

a shaft rotationally supported by a first bearing and a second bearing within the compressor housing;

a first impeller operably connected to the shaft at a first end of the shaft;

a second impeller operably connected to the shaft at a second end of the shaft;

a motor operably connected to the shaft between the first bearing and the second a cooling circuit comprising:

bearing; and a coolant inlet passage defined by the compressor housing for introducing an inlet coolant flow into the cooling circuit; and a cooling channel defined by the compressor housing and connected in fluid communication with the coolant inlet passage, wherein the cooling channel extends helically around the motor, the cooling channel includes a first portion and a second portion and wherein each of the first portion and the second portion extends from the coolant inlet passage to respective first and second outlets such that the inlet coolant flow is split into a first coolant flow along the first portion and a second coolant flow along the second portion, wherein each of the first portion and the second portion includes a respective flow resistance coefficient, and wherein the flow resistance coefficient of the first portion is greater than the flow resistance coefficient of the second portion.

11. The compressor system of claim 10, wherein each of the flow resistance coefficients is a function of a cross-sectional area of the respective first or second portion, a length of the respective first or second portion, an outlet area of the respective first or second portion, and a friction coefficient of the respective first or second portion.

12. The compressor system of claim 10, wherein a flow rate of the second coolant flow is greater than a flow rate of the first coolant flow.

13. The compressor system of claim 10, wherein 55%-60% of the inlet coolant flow flows along the second portion and 40%-45% of the inlet coolant flow flows along the first portion.

14. The compressor system of claim 10, wherein a length of the first portion is greater than a length of the second portion.

15. The compressor system of claim 10, wherein a length of the first portion is between 55-65% of a total length of the cooling channel.

16. The compressor system of claim 10, wherein each of the first portion and the second portion includes a number of channel turns around the motor, and wherein the first portion includes more channel turns than the second portion.

17. The compressor system of claim 10, wherein a first outlet area of the first outlet is smaller than a second outlet area of the second outlet.

18. The compressor system of claim 10, wherein coolant flow exiting the first outlet is delivered to the first bearing and the coolant flow exiting the second outlet is delivered to the second bearing.

19. A compressor system comprising:

a compressor housing;

a shaft rotationally supported by a first bearing and a second bearing within the compressor housing;

a first impeller operably connected to the shaft at a first end of the shaft;

a second impeller operably connected to the shaft at a second end of the shaft;

a motor operably connected to the shaft between the first bearing and the second bearing; and a cooling circuit comprising:

a coolant inlet passage defined by the compressor housing for introducing an inlet coolant flow into the cooling circuit; and a channel connected in fluid communication with the coolant inlet passage, wherein the channel wraps at least partially around the motor, the channel includes a first portion and a second portion, and wherein each of the first portion and the second portion extends from the coolant inlet passage to respective first and second outlets such that the inlet coolant flow is split into a first coolant flow along the first portion and a second coolant flow along the second portion, wherein a cross-sectional area of the first portion is substantially the same as a cross-sectional area of the second portion, and wherein the first portion has a first length longer than a second length of the second portion.

* * * * *